US005971183A

United States Patent [19]

Bartsch

[11] Patent Number: 5,971,183

[45] Date of Patent: Oct. 26, 1999

[54] TAMPER-EVIDENT LEAK-TIGHT CLOSURE FOR CONTAINERS

[75] Inventor: Eric R. Bartsch, Cincinnati, Ohio

[73] Assignee: The Procter & Gamble Company, Cincinnati, Ohio

[21] Appl. No.: 08/572,950

[22] Filed: Dec. 15, 1995

[51] Int. Cl.[6] ..... B65D 41/46; B65D 41/48

[52] U.S. Cl. ..... 215/256; 215/320; 215/321; 215/344; 215/354

[58] Field of Search ..... 215/256, 254, 215/211, 224, 225, 317, 321, 341, 343, 346, 253, 320, 344, 354; 220/265, 266, 276, 780, 792

[56] References Cited

U.S. PATENT DOCUMENTS

| | | |
|---|---|---|
| 2,947,432 | 8/1960 | Marcel . |
| 3,120,900 | 2/1964 | Faulstich . |
| 3,216,610 | 11/1965 | Klygis . |
| 3,247,994 | 4/1966 | Fuglsand-Madsen et al. . |
| 3,695,475 | 10/1972 | Ruekberg . |
| 3,817,418 | 6/1974 | Mastrovito . |
| 3,860,137 | 1/1975 | Wilson . |
| 3,893,583 | 7/1975 | McLaren . |
| 3,902,621 | 9/1975 | Hidding . |
| 3,985,255 | 10/1976 | Blair . |
| 4,037,746 | 7/1977 | Ver Hage . |
| 4,043,475 | 8/1977 | Wheeler . |
| 4,066,180 | 1/1978 | Sanchez . |
| 4,066,182 | 1/1978 | Allen et al. . |
| 4,106,653 | 8/1978 | Martinelli . |
| 4,166,552 | 9/1979 | Faulstich . |
| 4,177,906 | 12/1979 | Von Hagel . |
| 4,202,455 | 5/1980 | Faulstich . |
| 4,209,102 | 6/1980 | Dunn et al. . |
| 4,307,821 | 12/1981 | McIntosh . |
| 4,322,010 | 3/1982 | Curry . |
| 4,342,400 | 8/1982 | Llera . |
| 4,385,708 | 5/1983 | Curry . |
| 4,387,818 | 6/1983 | Conti . |
| 4,416,383 | 11/1983 | Frahm et al. . |
| 4,417,666 | 11/1983 | Roberts . |
| 4,484,687 | 11/1984 | Bullock, III . |
| 4,561,553 | 12/1985 | Crisci . |
| 4,577,771 | 3/1986 | Martinez . |
| 4,585,135 | 4/1986 | Sinnott . |
| 4,589,561 | 5/1986 | Crisci . |
| 4,593,830 | 6/1986 | Bullock . |
| 4,658,977 | 4/1987 | Crisci . |
| 4,667,839 | 5/1987 | Crisci . |
| 4,676,389 | 6/1987 | Bullock . |
| 4,678,094 | 7/1987 | Bullock . |
| 4,682,706 | 7/1987 | DeVore et al. . |
| 4,687,114 | 8/1987 | Crisci . |
| 4,691,834 | 9/1987 | Bullock, III . |
| 4,699,285 | 10/1987 | Perne et al. . |
| 4,699,286 | 10/1987 | Nolan . |
| 4,699,287 | 10/1987 | Bullock . |
| 4,700,860 | 10/1987 | Li . |
| 4,759,465 | 7/1988 | Landis . |
| 4,801,032 | 1/1989 | Crisci . |
| 4,815,617 | 3/1989 | Cullum . |

(List continued on next page.)

FOREIGN PATENT DOCUMENTS

| | | |
|---|---|---|
| 0 234 769 | 9/1987 | European Pat. Off. . |

*Primary Examiner*—Stephen K. Cronin
*Assistant Examiner*—Niki M. Eloshway
*Attorney, Agent, or Firm*—William Scott Andes

[57] ABSTRACT

Disclosed is a closure for a container, such as a blow molded jug having a neck surrounding an opening therein, the closure having a first annular portion and a second annular portion. The first annular portion in the closure has a wiper seal and a lip seal. The second annular portion exerts an upward pressure on the lip seal which causes improved sealing and leak-tight properties during shipping, handling, etc. The upward pressure also enhances the effectiveness of the wiper seal. The second annular portion may include an annular tear skirt having a pull tab for the removal thereof to facilitate removal of the closure from the container. The closure may also include a plug seal, and a lower annular portion extending from the second annular portion.

19 Claims, 3 Drawing Sheets

U.S. PATENT DOCUMENTS

| | | |
|---|---|---|
| 4,815,620 | 3/1989 | Bullock, III . |
| 4,828,128 | 5/1989 | Tackles . |
| 4,844,268 | 7/1989 | Bullock, III . |
| 4,884,707 | 12/1989 | Crisci . |
| 4,903,849 | 2/1990 | Wallman . |
| 4,934,546 | 6/1990 | Markley . |
| 4,966,292 | 10/1990 | Marino . |
| 4,971,213 | 11/1990 | Ishinabe et al. . |
| 5,036,991 | 8/1991 | Wallman . |
| 5,046,632 | 9/1991 | Bordner . |
| 5,050,754 | 9/1991 | Marino . |
| 5,092,478 | 3/1992 | La Pierre . |
| 5,104,008 | 4/1992 | Crisci . |
| 5,143,235 | 9/1992 | Repp . |
| 5,207,340 | 5/1993 | Cochrane . |
| 5,224,616 | 7/1993 | Crisci . |
| 5,285,912 | 2/1994 | Molinaro . |
| 5,307,945 | 5/1994 | Hidding et al. . |
| 5,373,955 | 12/1994 | Marino . |
| 5,395,003 | 3/1995 | Matsuda . |
| 5,456,376 | 10/1995 | Luch et al. . |

TAMPER-EVIDENT LEAK-TIGHT CLOSURE FOR CONTAINERS

FIELD OF THE INVENTION

The present invention relates to tamper-evident, leak-tight closures for containers, such as blow-molded plastic jugs, which are widely used in the food and beverage industry for the expendable packaging of consumables, such as cold drinks and the like. The present invention has further relation to such devices that have a frangible pull-tab for releasing and removing the closure from the container.

BACKGROUND OF THE INVENTION

Prior related closures of this general type may be seen, for example, in U.S. Pat. Nos. 3,893,583, 4,037,746, 4,066,182, 4,202,455, and 4,589,561. There are several problems with these prior art closures, however.

Maximum dimensional control of blow molded, plastic containers is achieved at the outer surface of the container, which is formed in contact with the mold. The inner edges of the mouths of blow molded containers are trimmed, and because the trimming operation is not precise, the edges are not necessarily flat and free of burrs or other formations which would effect their dimensions. Consequently, any seal, such as a plug seal, that attempts to seal a container at these inner edges is subject to the non-uniformity in dimension caused by the trimming operation. A much more dependable seal may be achieved at, for example, the outer rim of the mouth of a container where the molded dimensions are more uniform.

Some prior art devices attempt to seal containers along a trimmed edge rather than a molded outer surface. This makes the device prone to leakage. Some that attempt to seal at the outer surface of containers do so inadequately, and are known to leak during shipping and storage of the containers. This offends consumers and makes the products undesirable and sometimes unsaleable. Some achieve adequate sealability at the expense of aesthetic, cost, and ease-of-use considerations. Still others are configured such that they are difficult to remove from molds during their manufacture.

There has therefore been a desire to have a tamper-evident closure for containers, including improved sealability, which eliminates leakage during shipping, storage, and handling, while remaining aesthetically pleasing to consumers, easy to use, and inexpensive to produce. There is also a desire to provide such a closure, including a frangible pull-tab for easily releasing and removing the closure from containers, and which is relatively easy to remove from molds during manufacture.

SUMMARY OF THE INVENTION

Disclosed is a closure for a container, the container being of a type that has a neck area, a top opening, an annular top surface with a periphery and an inner edge which defines the top opening, a top outer rim extending from the periphery of the annular top surface, the top outer rim defining a first plane, a lip formed at the lower edge of the top outer rim, and a bottom outer rim extending from the neck area. The closure has a top member which covers the opening, the top member has an inner surface and an outer surface. The closure also has a first annular portion extending from the top member, the first annular portion defining a second plane, the first plane being substantially parallel to the second plane. The first annular portion further comprises a lip seal which comes into sealing contact with the lip. The first annular portion may also comprise a wiper seal which comes into contact with the top outer rim. The closure also has a second annular portion extending from the first annular portion. The second annular portion has a bottom foot which comes into pressurized contact with the bottom outer rim such that a compressive force is exerted on the second annular portion and the lip seal is forced into sealable contact with the lip.

The closure may have at least one line of weakness formed in the second annular portion at a position between the lip seal and the foot, and a pull tab having a first end and a second end, the pull tab being attached to the second annular portion at the first end, whereby the pull tab may be pulled outwardly to fracture the line of weakness and remove a substantial portion of the second annular portion from the closure to facilitate removal of the closure from the container. The pull tab may be frangibly connected to the second annular portion at the second end.

There may also be a lower portion extending from the bottom foot, the lower portion allowing improved ease of removal of the closure from a manufacturing mold during manufacture of the closure. A plug seal extending from the inner surface of the top member, and coming substantially into contact with the inner edge of the annular top surface may be included. Also, a portion of the top member may be recessed into the plug seal.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
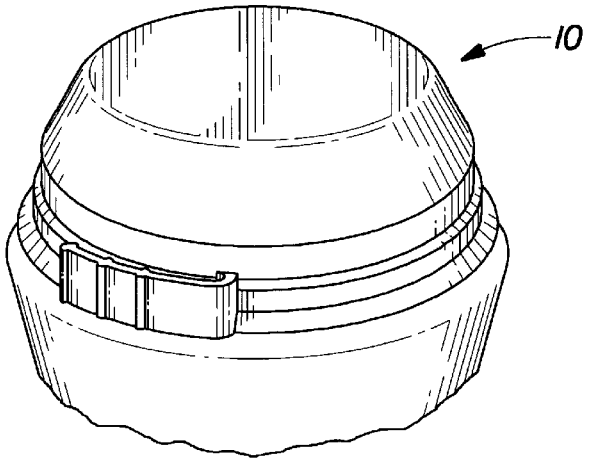
FIG. 1 is a vertical perspective view of a closure of the present invention, showing the closure as applied to a container.

Referring now to the drawings in detail wherein like numerals indicate the same element throughout the views, there is shown in FIGS. 1–5 an embodiment of a closure 10 of the present invention as applied to the top of a container. Particularly referring to FIGS. 2 and 3, the container typically has a neck area and an opening. The opening is encompassed by an annular top surface 12, which in turn has an inner edge 14 and a periphery 16. A top outer rim 18 angles downwardly and outwardly from the periphery 16 of annular top surface 12. The outer surface of the top outer rim 18 serves as a "seat" for one of the seals of the closure. The lower edge of the top outer rim 18 overhangs a vertical portion of the neck area and forms lip 20. Lip 20 serves as a "seat" for another of the seals of the closure. Bottom outer rim 22 extends downwardly and outwardly from the lower end of the vertical portion of the neck area and serves as a "seat" for a portion of the closure. This "seat" exerts compressive forces on the closure so as to maximize the effectiveness of the seals and provide for a leak-proof container; this will subsequently be described in greater detail.

The closure 10 has a top member 24 which acts as a cover for the opening in the top of the container. The top member 24 may or may not have a plug seal 25 extending downward from its inside surface, such that the plug seal 25 is substantially forced into the opening along the inner edge 14, and provides for redundant sealing and stability of the closure 10. Extending at an angle from top member 24 is a first annular portion 26. On the inside surface of first annular portion 26 there may be a wiper seal 28 which comes into sealing contact with the outer surface of top outer rim 18. Wiper seal 28 may be positioned anywhere along the inner surface of first annular portion 26 while maintaining an adequate seal, but the most desirable position for wiper seal 28 has been found to be at the low end of annular portion 26 approaching lip 20. Lip seal 30 is also positioned on the inside surface of annular portion 26 such that it mates with and engages lip 20. The relationship among wiper seal 28, lip seal 30, and the compressive forces exerted on them, will be described in more detail below.

A second annular portion 32 extends downwardly from the first annular portion 26. At the lower end of second annular portion 32 is a bottom foot 34 which is configured to engage with bottom outer rim 22. The area of closure 10 between lip seal 30 and bottom foot 34 is dimensioned with respect to the area of the container between lip 20 and bottom outer rim 22 such that when closure 10 is secured onto the container, a compressive force is exerted on closure 10 between foot 34 and lip seal 30. This results in a seal between lip 20 and lip seal 30 of maximum effectiveness.

When wiper seal 28 is included on first annular portion 26, the increase in leak-proof sealability of closure 10 becomes dramatic. In addition to the effectiveness of lip seal 30, wiper seal 28 is particularly effective due to a bending moment caused at the point of contact between lip 20 and lip seal 30, and which runs around that same point. This moment is caused by the upwardly exerted compressive force within second annular portion 32. This compressive force causes first annular portion 26 to rotate inward around lip 20, and pushes wiper seal 28 into secure sealing contact with top outer rim 18. In the view shown in FIG. 3, the moment would be counterclockwise around the point of contact between the lip 20 and lip seal 30.

Figure 7:
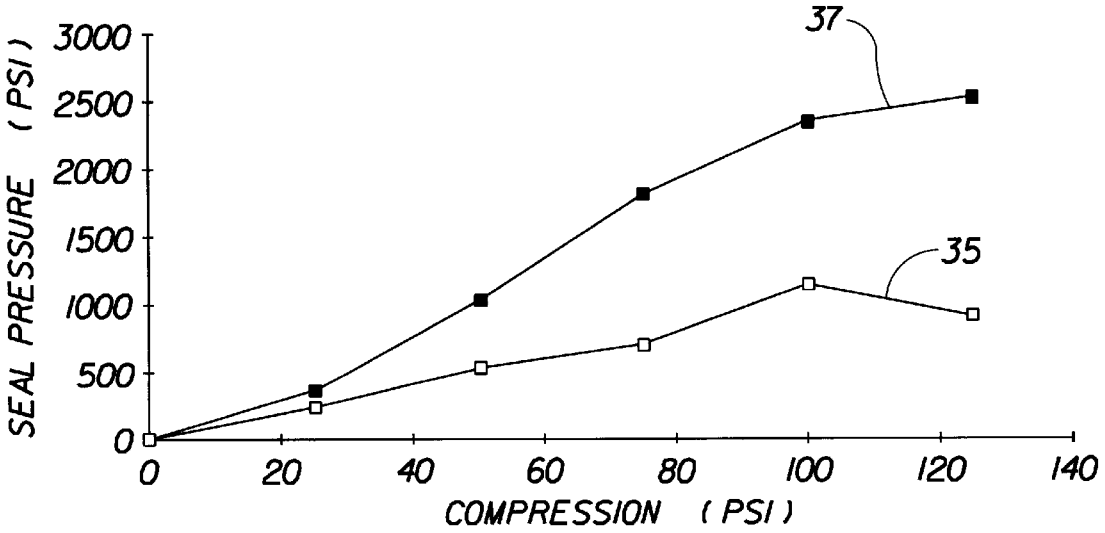
FIG. 7 is a chart showing the relationship between the compression in the second annular portion of the closure and the pressures applied by both the wiper and lip seals of the present invention.

FIG. 7 shows curves depicting the general relationship between the compressive force within second annular portion 32 (the "X" axis) and the pressure on both the lip seal 30 and wiper seal 28 (the "Y" axis), for a specific embodiment of closure 10. These curves are exemplary, and do not predict this exact relationship for every possible embodiment of the present invention. The lower curve 35 shows the increase in sealing pressure on lip seal 30 as the compressive force in second annular portion 32 increases. The pressure on lip seal 30 increases substantially steadily with the compressive force. However at some point the compressive force will become excessive and buckling will occur in second annular portion 32, especially when second annular portion 32 includes line of weakness 36, described below. The upper curve 37 in FIG. 7 shows that wiper seal 28 becomes particularly effective with increased compression of second annular portion 32, and provides for about double the sealing force per unit area over that of lip seal 30 for a given amount of compression within second annular portion 32. This is due to the aforementioned moment, which rotates about the point of contact between lip 20 and lip seal 30, and pushes wiper seal 28 into top outer rim 18.

Figure 2:
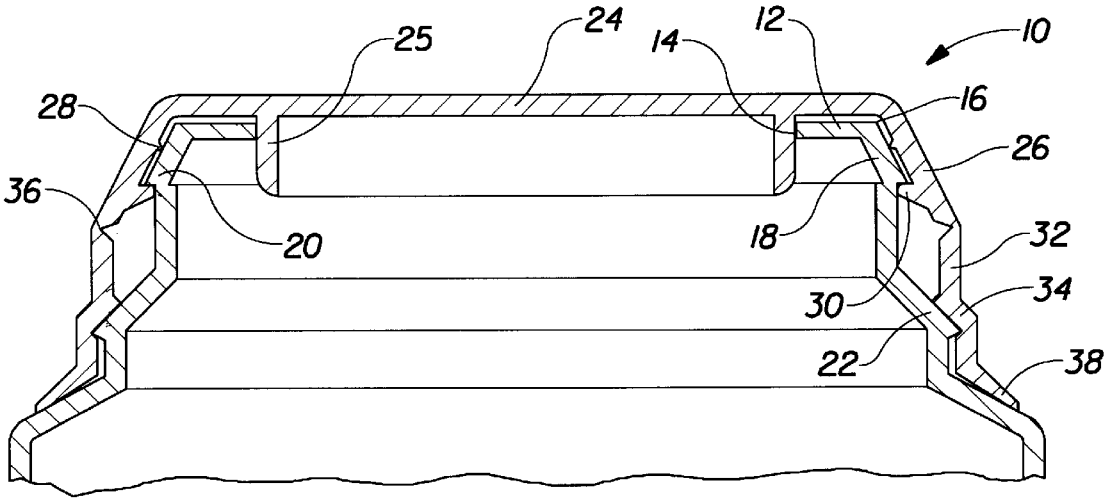
FIG. 2 is a vertical sectional view through a closure of the present invention, and a neck of a container on which the closure is applied.
Figure 3:
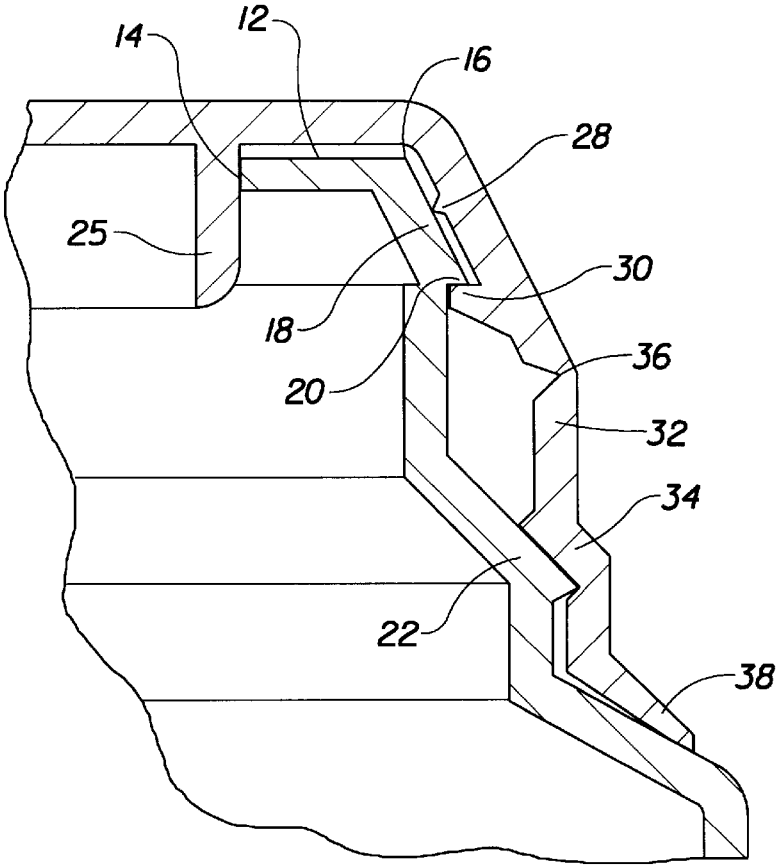
FIG. 3 is a vertical sectional view through a portion of the closure and a portion of a neck of a container on which the closure is applied.
Figure 4:
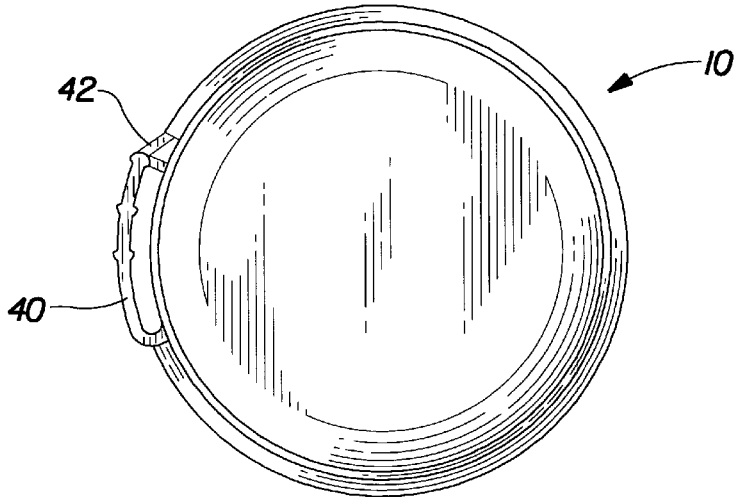
FIG. 4 is a top plan view of the closure showing the pull-tab configuration.
Figure 5:
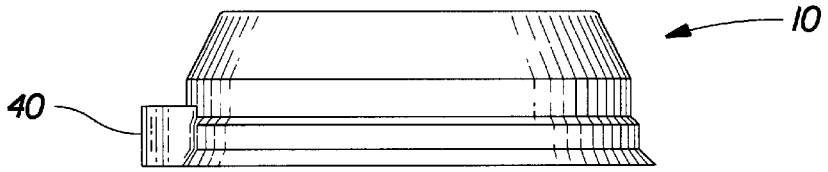
FIG. 5 is a side elevational view of the closure.

Referring to FIGS. 2 and 3, a lower portion 38 may extend downwardly and outwardly from bottom foot 34. Lower portion 38 is not necessary to the proper functioning of closure 10, and serves more of an aesthetic purpose. It has, however, been found to be useful in increasing the ease of removal of the closure from the molds during manufacture.

Within second annular portion 32, there may be positioned at least one line of weakness 36 which is purposely fractured when removal of closure 10 from the container is desired, to release compressive forces in second annular portion 32 and to facilitate removal of closure 10 from the container. A pull tab 40, shown in FIG. 4, may be attached to either lower portion 38, or second annular portion 32, or both, such that when the tab 40 is pulled, line of weakness 36 fractures, and most or all of second annular portion 32, and all of lower portion 38, may be completely removed to provide for opening of the container. The outer end of pull tab 40 may be connected to lower portion 38 by a small frangible piece of material 42, to prevent tab 40 from being moved and causing inadvertent fracture of line of weakness 36 during shipping, handling, etc. This type of closure removal system is well known in the art.

Figure 6:
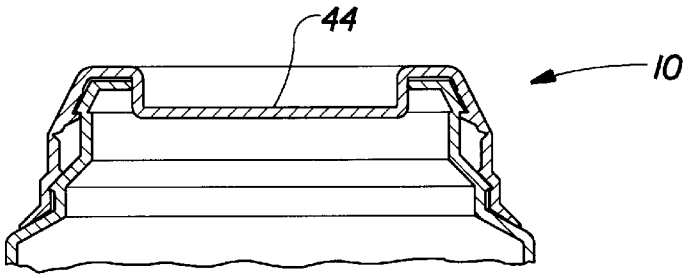
FIG. 6 is a vertical sectional view of an alternative embodiment of the closure of the present invention.

As shown in FIG. 6, a portion 44 of top member 24 may be recessed into plug seal 25 to provide for a depression on the top surface of closure 10. However, this is usually undesirable because of the tendency for such a depression to collect dirt, dust, and other undesirable matter that would offend the consumer.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A container having a closure, the container having a central longitudinal axis and being of a type that has a neck area, a top opening, an annular top surface with a periphery and an inner edge, the inner edge defining the top opening, a top outer rim extending from the periphery of the annular top surface, a lip formed at a lower edge of the top outer rim, and a bottom outer rim extending from the neck area the closure comprising:

(a) a top member which covers the opening, the top member having an inner surface and an outer surface;

(b) a first annular portion extending downwardly from the top member, the first annular portion further comprising a lip seal which comes into sealing contact with the lip; and (c) a second annular portion extending downwardly from the first annular portion, the second annular portion being generally located at a greater radial distance from the longitudinal axis than the first annular portion, the second annular portion having a bottom foot which comes into pressurized contact with the bottom outer rim and a weakened portion between the lip seal and the foot which acts as a hinge, such that a vertical compressive force is exerted on the second annular portion forcing the lip seal into sealable contact with the lip and creating a bending moment at the point of contact between the lip and the lip seal which causes the first annular portion to rotate inward toward the top outer rim as the lip exerts a downwardly directed force on the lip seal.

2. The closure of claim 1, wherein the top outer rim defines a first plane and the first annular portion defines a second plane, the first plane being substantially parallel to the second plane, the closure further comprising a wiper seal on the first annular portion which comes into sealing contact with the top outer rim.

3. The closure of claim 1, further comprising a plug seal extending from the inner surface of the top member, and coming substantially into contact with the inner edge of the annular top surface.

4. The closure of claim 3, wherein at least a portion of the top member is recessed into the plug seal.

5. The closure of claim 1, further comprising at least one line of weakness formed in the second annular portion at a position between the lip seal and the foot, and a pull tab having a first end and a second end, the pull tab being at least partially attached to the second annular portion at the first end, whereby the pull tab may be pulled outwardly to fracture the line of weakness and remove a substantial portion of the second annular portion from the closure to facilitate removal of the closure from the container.

6. The closure of claim 5, further comprising a lower portion extending from the bottom foot, the lower portion allowing improved ease of removal of the closure from a manufacturing mold during manufacture of the closure.

7. The closure of claim 6, wherein the pull tab is frangibly connected to the lower portion at the second end.

8. A container having a closure, the container having a central longitudinal axis and being of a type that has a neck area, a top opening, an annular top surface with a periphery and an inner edge, the inner edge defining the top opening, a top outer rim extending downwardly and outwardly from the periphery of the annular top surface, the top outer rim defining a first plane, a lip formed at a lower edge of the top outer rim, and a bottom outer rim extending outwardly from the neck area, the closure comprising:

(a) a top member which covers the opening, the top member having an inner surface and an outer surface;

(b) a first annular portion extending downwardly and outwardly from the top member, the first annular portion defining a second plane, the first plane being substantially parallel to the second plane, the first annular portion further comprising a lip seal which comes into sealing contact with the lip; and (c) a second annular portion extending downwardly from the first annular portion, the second annular portion being generally located at a greater radial distance from the longitudinal axis than the first annular portion, the second annular portion having a bottom foot which comes into pressurized contact with the bottom outer rim and a weakened portion between the lip seal and the foot which acts as a hinge, such that a vertical compressive force is exerted on the second annular portion, forcing the lip seal into sealable contact with the lip and creating a bending moment at the point of contact between the lip and the lip seal which causes the first annular portion to rotate inward toward the top outer rim as the lip exerts a downwardly directed force on the lip seal.

9. The closure of claim 8, further comprising a wiper seal on the first annular portion which comes into sealing contact with the top outer rim.

10. The closure of claim 9, further comprising a plug seal extending downwardly from the inner surface of the top member, and coming substantially into contact with the inner edge of the annular top surface.

11. The closure of claim 10, wherein at least a portion of the top member is recessed into the plug seal.

12. The closure of claim 10, further comprising a downwardly and outwardly extending lower portion extending from the bottom foot, the lower portion allowing improved ease of removal of the closure from a manufacturing mold during manufacture of the closure.

13. The closure of claim 12, further comprising at least one line of weakness formed in the second annular portion at a position between the lip seal and the foot, and a pull tab having a first end and a second end, the pull tab being at least partially attached to the second annular portion at the first end, whereby the pull tab may be pulled outwardly to fracture the line of weakness and remove a substantial portion of the second annular portion from the closure to facilitate removal of the closure from the container.

14. The closure of claim 13, wherein the pull tab is frangibly connected to the lower portion at the second end.

15. A container having a closure, the container having a central longitudinal axis and being of a type that has a neck area, a top opening, an annular top surface with a periphery and an inner edge, the inner edge defining the top opening, a top outer rim extending downwardly and outwardly from the periphery of the annular top surface, the top outer rim defining a first plane, a lip formed at a lower edge of the top outer rim, and a bottom outer rim extending outwardly from the neck area, the closure comprising:

(a) a top member which covers the opening, the top member having an inner surface and an outer surface;

(b) a first annular portion extending downwardly and outwardly from the top member, the first annular portion defining a second plane, the first plane being substantially parallel to the second plane, the first annular portion further comprising a wiper seal which comes into sealing contact with the top outer rim, and a lip seal which comes into sealing contact with the lip; and (c) a second annular portion extending downwardly from the first annular portion, the second annular portion being generally located at a greater radial distance from the longitudinal axis than the first annular portion, the second annular portion having a bottom foot which comes into pressurized contact with the bottom outer rim and a weakened portion between the lip seal and the foot which acts as a hinges, such that a vertical compressive force is exerted on the second annular portion, forcing the lip seal into sealable contact with the lip and creating a bending moment at the point of contact between the lip and the lip seal which causes the first annular portion to rotate inward toward the top outer rim as the lip exerts a downwardly directed force on the lip seal; and (d) a plug seal extending downwardly from the inner surface of the top member, and coming substantially into contact with the inner edge of the annular top surface.

16. The closure of claim 15, further comprising at least one line of weakness formed in the second annular portion at a position between the lip seal and the foot, and a pull tab having a first end and a second end, the pull tab being at least partially attached to the second annular portion at the first end, whereby the pull tab may be pulled outwardly to fracture the line of weakness and remove a substantial portion of the second annular portion from the closure to facilitate removal of the closure from the container.

17. The closure of claim 16, further comprising a downwardly and outwardly extending lower portion extending from the bottom foot, the lower portion allowing improved ease of removal of the closure from a manufacturing mold during manufacture of the closure.

18. The closure of claim 17, wherein the pull tab is frangibly connected to the lower portion at the second end.

19. The closure of claim 18 wherein at least a portion of the top member is recessed into the plug seal.

* * * * *